US010415436B2

(12) United States Patent
Simcina et al.

(10) Patent No.: US 10,415,436 B2
(45) Date of Patent: Sep. 17, 2019

(54) DAMPER FOR A HIGH PRESSURE CHAMBER OF A VARIABLE VALVE TRAIN MODULE

(71) Applicant: Schaeffler Technologies AG & Co. KG, Herzogenaurach (DE)

(72) Inventors: Todd Simcina, Huntington Woods, MI (US); Bradley P. Bergsma, Windsor (CA); Justin LaPorte, Tecumseh (CA); Rong Zhang, Rochester Hills, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 77 days.

(21) Appl. No.: 15/612,563

(22) Filed: Jun. 2, 2017

(65) Prior Publication Data

US 2018/0347413 A1 Dec. 6, 2018

(51) Int. Cl.

| | |
|---|---|
| ***F01L 1/14*** | (2006.01) |
| ***F01L 1/24*** | (2006.01) |
| ***F01L 1/047*** | (2006.01) |
| ***F01L 1/18*** | (2006.01) |

(52) U.S. Cl.

CPC ..... *F01L 1/2416* (2013.01); *F01L 1/047* (2013.01); *F01L 1/146* (2013.01); *F01L 1/18* (2013.01); *F01L 2001/2427* (2013.01)

(58) Field of Classification Search

CPC ... F01L 1/181; F01L 1/24; F01L 1/047; F01L 1/18; F01L 1/146; F01L 1/2416; F01L 2001/2427

USPC ..... 123/90.12, 90.13, 90.39, 90.44, 90.16

See application file for complete search history.

(56) References Cited

U.S. PATENT DOCUMENTS

| | | | |
|---|---|---|---|
| 4,219,109 A | 8/1980 | Ushijima et al. | |
| 6,257,183 B1 | 7/2001 | Vorih et al. | |
| 6,415,752 B1 * | 7/2002 | Janak | F01L 1/181 123/90.12 |

OTHER PUBLICATIONS

Gecim et al., Cam-Driven Hydraulic Lost-Motion Mechanisms for Overhead Cam and Overhead Valve Valvetrains, US Patent Application Pub. No. US 2009/0308340 A1, Dec. 17, 2009. (Year: 2009).*

* cited by examiner

*Primary Examiner* — Ching Chang
(74) *Attorney, Agent, or Firm* — Volpe and Koenig, P.C.

(57) ABSTRACT

A variable valve train module selectively controls the opening and closing of a valve of an engine. The variable valve train module includes a drive element configured to be driven by a cam which rotates on a camshaft, a pump which is driven by the drive element, and a hydraulic control unit. The hydraulic control unit is configured to control the engine valve. The hydraulic control unit has a high pressure chamber containing hydraulic fluid which is selectively pressurized by the pump. The hydraulic control unit also has a control valve which is configured to depressurize the high pressure chamber, and a damper which is configured to increase an effective volume of the high pressure chamber when a pressure in the high pressure chamber exceeds a threshold value.

16 Claims, 4 Drawing Sheets

DAMPER FOR A HIGH PRESSURE CHAMBER OF A VARIABLE VALVE TRAIN MODULE

FIELD OF INVENTION

The present invention relates to a damper, and, more particularly, to a damper for a high pressure chamber of a variable valve train module.

BACKGROUND

Some engines include a variable valve train module which controls valve lift through hydraulic operation. This module can include a valve control block positioned on one or more cylinder heads of an engine. The valve control block can include various spaces for components and cavities for hydraulic fluid which together control valve timing and lift. Hydraulic valve control systems provide fully variable valve lift capabilities, which promotes engine efficiency (e.g., through precise variable valve actuation and timing depending on the situation).

During operation of the hydraulic valve control system, a high pressure chamber is periodically pressurized and drained. This allows the fluid in the chamber to be used as hydraulic pushrod to open the valve when needed or as a disconnection which produces zero or limited lift. However, the nature of the operation may produce pressure fluctuations which are severe enough to produce undesirable engine noise. For example, the cyclical changes in pressure could produce a forcing function input which is a source of vibration for the engine and nearby components.

The present disclosure is directed to overcoming one or more problems of the prior art, including providing the advantages of a hydraulic valve control system without producing engine noise.

SUMMARY

In one aspect, the present disclosure is directed to a variable valve train module. The variable valve train module includes a drive element configured to be driven by a cam which rotates on a camshaft, a pump which is driven by the drive element, and a hydraulic control unit configured to control an engine valve. The hydraulic control unit includes a high pressure chamber containing hydraulic fluid which is selectively pressurized by the pump, a control valve which is configured to depressurize the high pressure chamber, and a damper which is configured to increase an effective volume of the high pressure chamber when a pressure in the high pressure chamber exceeds a threshold value.

In another aspect, the present disclosure is directed to a variable valve train module. The variable valve train module includes a drive element configured to be driven by a cam which rotates on a camshaft, a pump which is driven by the drive element, and a hydraulic control unit configured to control an engine valve. The hydraulic control unit includes a high pressure chamber containing hydraulic fluid which is selectively pressurized by the pump, an orifice connecting the high pressure chamber to an open space, and a control valve which is configured to depressurize the high pressure chamber. The orifice may include a diameter of approximately 1 mm.

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

The present disclosure relates to a damper for a variable valve train module. The variable valve train module includes a high pressure chamber which experiences pressure spikes during operation. The disclosed damper absorbs some of the pressure increase by allowing an amount of hydraulic fluid to enter into a space which is created only when the pressure reaches a threshold level. In an exemplary embodiment, this is accomplished by a piston and spring assembly in which the spring is selected such that the piston compresses the spring only when a threshold level of pressure is reached, thereby creating the additional space for receiving hydraulic fluid. A small orifice which connects the damper and the high pressure chamber is sized to feed hydraulic fluid into the space created by the damper. The orifice acts as a hydraulic friction component which dampens energy associated with pressure oscillations in the pressure chamber.

Figure 1:
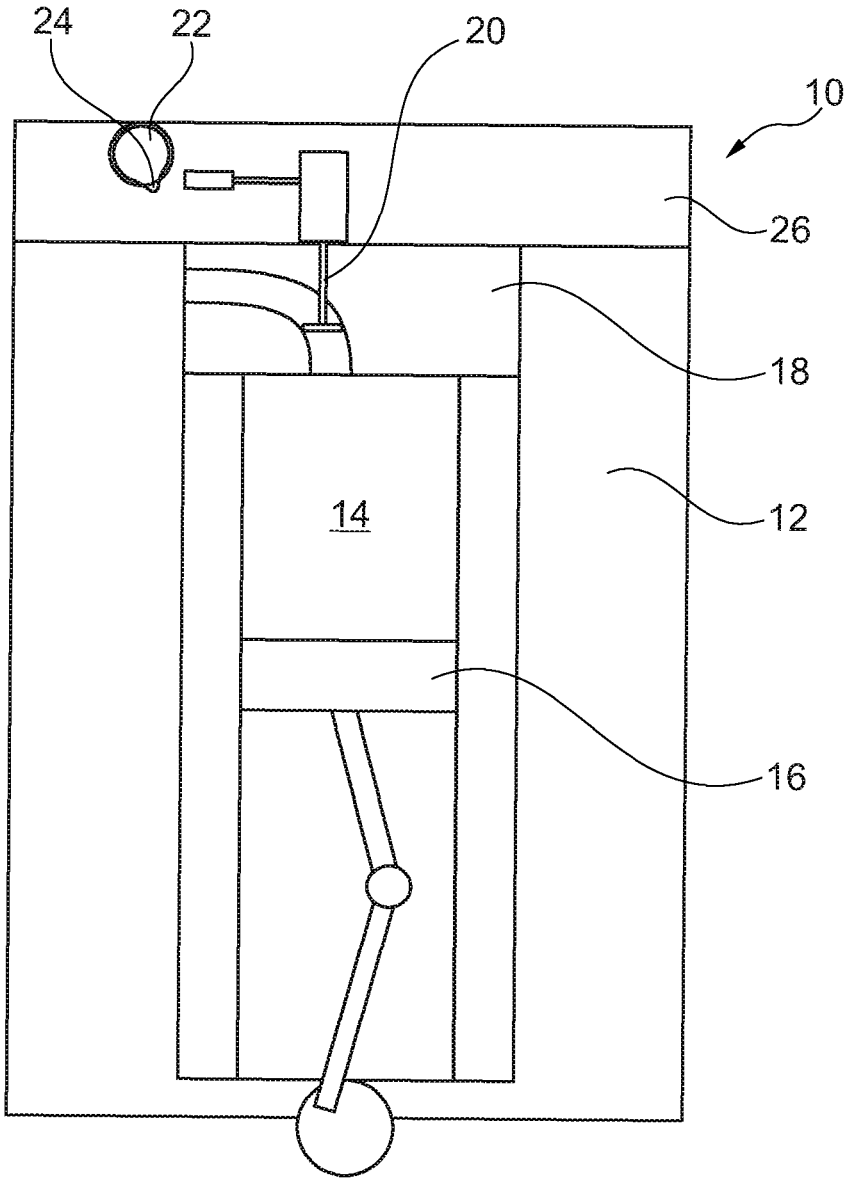
FIG. 1 is a schematic illustration of an exemplary engine.

FIG. 1 schematically illustrates an exemplary embodiment of an engine 10. The engine 10 may be any of several types of engines, including liquid and/or gaseous fueled internal combustion engines. It should be understood, however, that the engine 10 may be any type of engine that includes one or more of the components described herein. Further, the disclosed embodiments are not limited to use with engines, and could be implemented on other systems, such as other power, generator, and/or pump systems.

In one embodiment, the engine 10 includes an engine block 12 defining a plurality of cylinders 14. The cylinders 14 receive corresponding reciprocating pistons 16. The pistons 16 move within the cylinders 14 as the engine 10 cycles through various intake, power, compression, and exhaust stages.

The engine 10 further includes at least one cylinder head 18 which is positioned on top of the engine block 12. The cylinder head 18 includes cavities for receiving at least a portion of a valve 20. The valves 20 include intake and exhaust valves which are selectively opened and closed to facilitate the various combustion stages of the engine 10. In one embodiment, the valve 20 is a poppet valve configured to move between open and closed positions to thereby control flow of fluid through a corresponding opening, although other valve configurations are possible. The valves 20 may be operated at least in part due to a camshaft 22. The camshaft 22 rotates to provide a cyclical input through one or more cams 24.

The engine 10 also includes a variable valve train module 26. The variable valve train module 26 is positioned on the cylinder head 18 and includes components which control the valves 20. In alternative embodiments, the variable valve train module 26 is integrated with the cylinder head 18. The variable valve train module 26 includes features which convert the cyclical input of the cams 24 into a variably-controllable input to the valves 20. In this way, a lift profile of the valves 20 may be precisely adjusted and controlled through the variable valve train module 26 to promote efficient operation of the engine 10.

Figure 2:
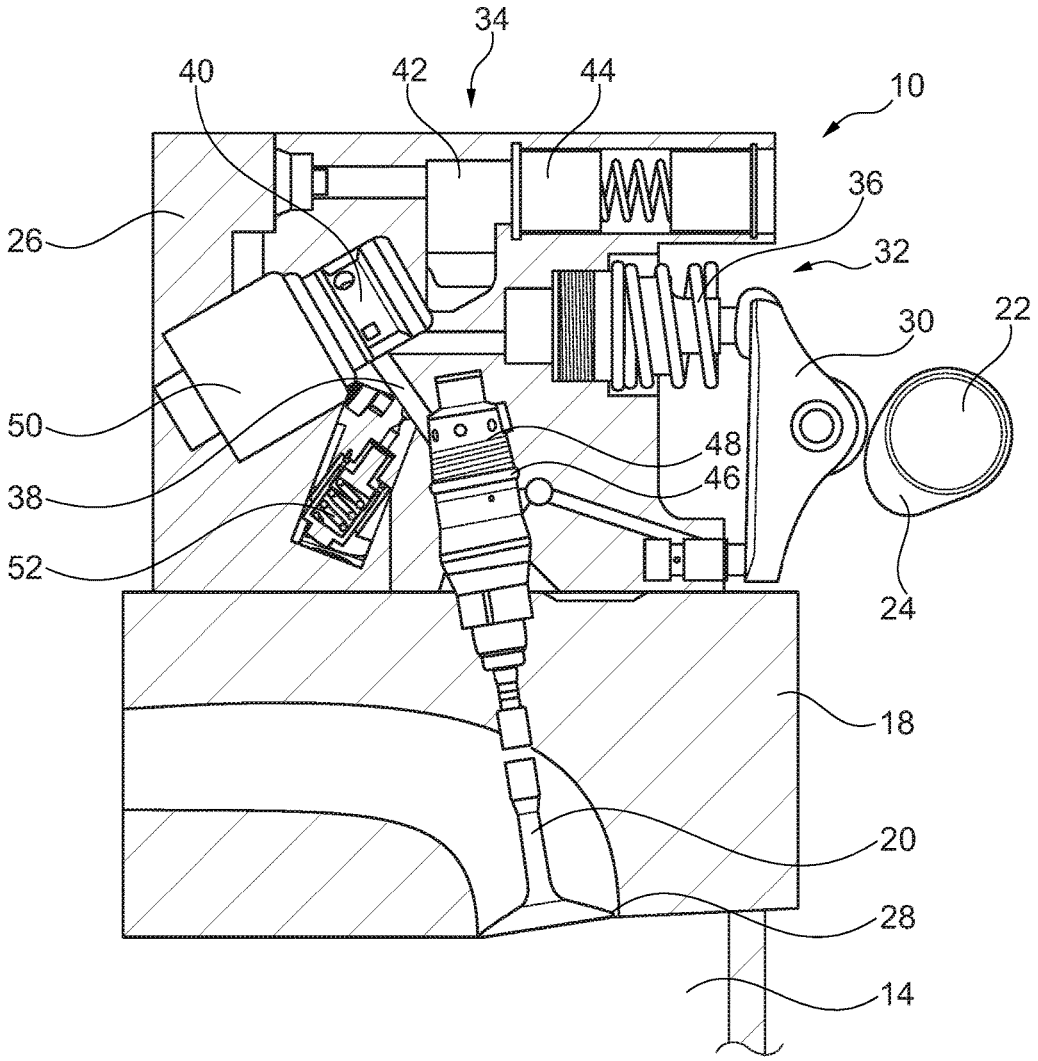
FIG. 2 is a schematic illustration of an exemplary variable valve train module which may be used in conjunction with the engine of FIG. 1.

FIG. 2 illustrates an exemplary embodiment of the variable valve train module 26 which is configured to selectively control the movement of the valve 20. In some embodiments, the valve 20 may be an intake valve configured to control the flow of air into the cylinder 14 (shown only in FIG. 1). The valve 20 rests against a valve seat 28 in a closed position, and moves away therefrom to allow air to flow through the corresponding opening.

The variable valve train module 26 further includes components configured to control the opening and closing of the valve 20. The variable valve train module 26 includes, for example, a drive element 30, a pump 32, and a hydraulic control unit 34. In an exemplary embodiment, the drive element 30 is driven by the camshaft 22 to provide input to the pump 32. The pump 32 provides a pressurizing force to the hydraulic control unit 34, which uses the pressure to control the valve 20.

The drive element 30, pump 32, and hydraulic control unit 34 operate in conjunction with each other to selectively open and/or close the valve 20. In one embodiment, the pump includes a piston assembly 36. The piston assembly 36 is operatively connected to the drive element 30. For example, the piston assembly 36 is operatively connected to a cam 24 of the camshaft 22 by the drive element 30, which may be a roller finger follower, lever, or the like. Other configurations of the drive element 30 are possible and/or may include additional or alternative features, such as a pushrod.

In an exemplary embodiment, the hydraulic control unit 34 includes at least a high pressure chamber 38, a control valve 40, and a damper 52. The hydraulic control unit 34 may also include an intermediate pressure chamber 42, a hydraulic accumulator 44, an activating cylinder 46, a brake 48, and a controller 50. It should be understood that the hydraulic control unit 34 may include any number of these components and may include additional or alternative components in other embodiments. The components of the hydraulic control unit 34 utilize the pressurizing input of the pump 32 to provide a system which selectively controls the opening and closing of the valve 20 through hydraulic pressure.

In one embodiment, the pump 32 pressurizes hydraulic fluid in the high pressure chamber 38 through movement of the piston assembly 36. For example, the drive element 30 is moved by the cam 24 via rotation of the camshaft 22. The drive element 30 transfers this movement to the piston assembly 36 which increases the pressure inside the high pressure chamber 38 by forcing fluid (e.g., hydraulic fluid or air) into the high pressure chamber 38. The cyclical motion of the cam 24 provides periodic input to the pump 32.

The control valve 40 is positioned between the high pressure chamber 28 and the intermediate pressure chamber 42. The control valve 40 may be, for example, an electronically-controlled solenoid valve. When the control valve 40 is opened, the free flow of fluid between the high pressure chamber 38 and the intermediate pressure chamber 42 is possible. In this situation, the pressure in the high pressure chamber 42 is relatively low, as the intermediate pressure chamber 42 includes a fluid inlet and outlet which allows for the free flow of fluid (i.e., the intermediate pressure chamber 42 is at a system pressure and is not a closed chamber). The high pressure chamber 38 is "high" in pressure in that it sometimes includes a pressure which exceeds the intermediate pressure chamber 42.

When the control valve 40 is closed, the high pressure chamber 38 is closed off from the intermediate pressure chamber 42, thereby allowing the pressure to build in the high pressure chamber 38. In this situation, hydraulic fluid in the high pressure chamber acts as a hydraulically-rigid pushrod that causes the valve 20 to move away from the valve seat 28 toward an open position (e.g., by overcoming a biasing force, for example of a valve spring, holding the valve 18 against the valve seat 20).

When the control valve 40 is re-opened, hydraulic fluid displaced by the piston assembly 36 is directed to the hydraulic accumulator 44, thereby lowering the pressure in or depressurizing the high pressure chamber 38. The depressurization causes the valve 20 to move toward the closed position (e.g., because the biasing force overcomes the lack of force from the hydraulic fluid). In this way, the pressure in the high pressure chamber 38 controls the valve 20. Various valve lift events are possible through control of the specific timing of the control valve 40. For example, zero lift may be achieved by leaving the control valve 40 open, as oil pressure builds in the hydraulic accumulator 44 instead of acting on the valve 20.

The activated cylinder 46 controls the opening and closing movement of the valve 20. For example, the activated cylinder 46 may be a slave cylinder which is driven by the hydraulic fluid in the high pressure chamber 38 when the pressure level is sufficient. The brake unit 48 may also be provided to prevent quick movements of the valve 20 that may cause damage, depending on the biasing force of a valve spring and any hydraulic damping provided by the activated cylinder 40.

The activation or deactivation, as well as the timing of the opening and closing of the valve 20, is therefore controllable by the hydraulic control unit 34, such as through signals from the controller 50. The controller 50 is preferably a processing unit, such as a vehicle ECM configured to electronically control the control valve 40 (e.g., via signals to a solenoid to open and close the control valve 40). It should be understood that other embodiments of the variable valve train module 26 are possible.

During operation of the variable valve train module 26, a pressure within the high pressure chamber 38 varies as pump 30 operates and the control valve 40 is opened and closed. In some instances, the changes in pressure may be rapid and cyclical, resulting in a periodic driving force within the variable valve train module 26 which may be a source of vibration. In order to lessen the change in pressure, the damper 52 is provided. The damper 52 reduces the pressure spikes, thereby inhibiting the variable valve train module 26 from producing excessive engine noise and vibration. In one example, pressure changes which may otherwise exceed 30 bar can be reduced to approximately 5-10 bar through use of the disclosed damping system.

Figure 3A:
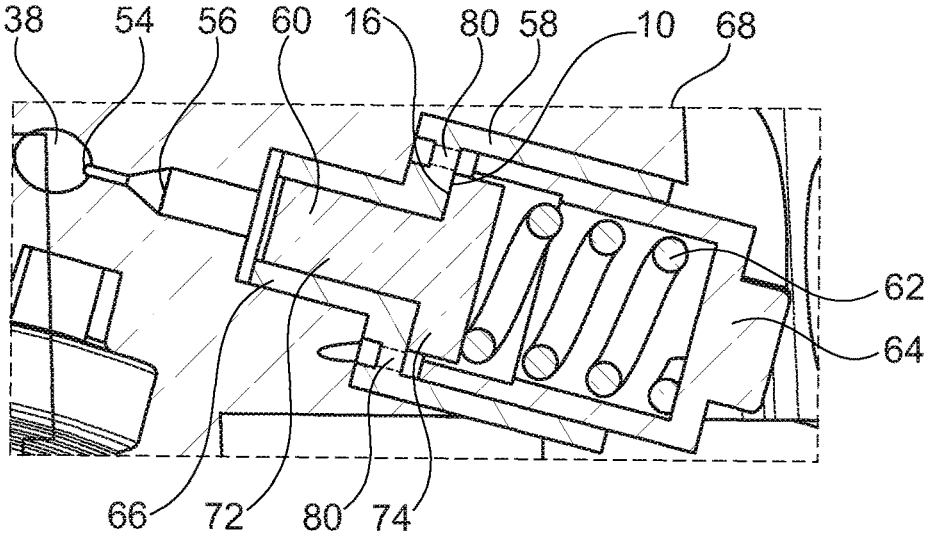
FIG. 3A is a cross-sectional view of a fluid damper which may be used in conjunction with the variable valve train module of FIG. 2, in a first position.
Figure 3B:
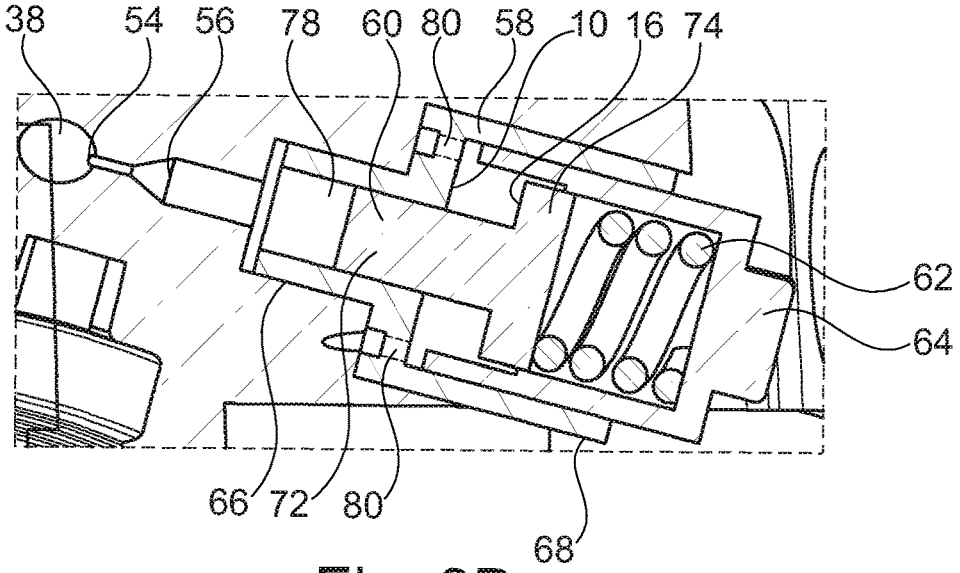
FIG. 3B is a cross-sectional view of the fluid damper of FIG. 3A, in a second position.

FIGS. 3A-3B further illustrate the damper 52 in more detail, according to an exemplary embodiment. The damper 52 is fluidly connected to the high pressure chamber 38 by an orifice 54. In general, the damper 52 may act by creating a space for receiving hydraulic fluid from the high pressure chamber 38 only when the pressure in the high pressure chamber 38 exceeds a threshold. In this way, the volume of the high pressure chamber 38 effectively increases at high pressure values, causing the pressure to level off and reducing pressure fluctuations. Moreover, the orifice 54 is sized to act as a hydraulic friction component which dampens the pressure fluctuation by introducing a restriction to the fluid flow.

As shown in FIG. 3A, the orifice 54 connects the high pressure chamber 38 to an inlet channel 56. The orifice 54 and the inlet channel 56 are sized to receive a selected amount of fluid therein and to produce a particular flow rate therethrough. In general, the smaller the size of the orifice, the greater the damping effect, up to a limit. At too small of sizes, the cost of manufacturing may become too great and the small amount of fluid which can enter may not have a damping effect. In an exemplary embodiment, the orifice 54 includes a diameter of approximately 1 mm and the inlet channel 56 includes a length of approximately 2-3 mm. As used herein, the term approximately at least encompasses values which are within 25% of the recited value or range. The inlet channel 56 leads to the damper 52 (although the orifice 54 and inlet channel 56 are effectively part of the overall damping system).

The damper 52 is preferably installed in the block that houses the components of the variable valve train module 26. For example, the damper 52 may be threaded into the block or otherwise attached. In an exemplary embodiment, the damper 52 includes at least a guide 58, a piston 60, and a spring 62. The damper may also include a retaining cap 64, which may be formed by a portion of the block in which the damper 52 is installed. The guide 58 includes a first portion 66 and a second portion 68. The first portion 66 is adjacent to and fluidly connected to the inlet channel 56. The second portion 68 is preferably wider than the first portion 66 and each are hollow. The first hollow portion 66 and second hollow portion 68 are preferably cylindrical, but other shapes are possible. A support surface 70 is formed at a junction between the first portion 66 and the second portion 68.

The piston 60 includes a first portion 72 and a second portion 74. The first portion 72 and the second portion 74 are preferably cylindrical to match the shape of the guide 58. The first portion 72 is narrower than the second portion 74 and fits within the first portion 66 of the guide 58. The second portion 74 may be formed as a flange or cap at the end of the first portion 72 and includes a contact surface 76 which abuts the support surface 70 when the piston 60 is in the position of FIG. 3A.

The spring 62 is preferably seated on the second portion 74 of the piston 60 and held in position by the retaining cap 64 relative to the guide 58 and the piston 60. The spring 62 exerts a force on the second portion 74 of the piston 60 to urge the contact surface 76 into contact with the support surface 70. This position, as illustrated in FIG. 3A, is a closed position of the damper 52. The guide 58 and retaining cap 64 are securely seated in the block of the variable valve train module 26 such that they are preferably fixed relative to each other. This allows the spring 62 to reliably exert a force on the piston 60 to hold the damper 52 in a closed position.

The piston 60 is slidable within the guide 58 from the closed position illustrated in FIG. 3A to an open position illustrated in FIG. 3B. The piston 60 is slidable against the force of the spring 62 to move further into the second portion 68 of the guide 58. This creates an open space 78 within the first portion 66 of the guide 58. The open space 78 is fluidly connected to the inlet channel 56 such that fluid can flow from the high pressure chamber 38, through the orifice 54 and inlet channel 56, and into the open space 78 vacated by the piston 60. The damper 52 may include a leak gap 80 which allows air to move into and out of the space where the spring 62 is located to facilitate the sliding movement of the piston 60 and may also allow excess fluid to leak out of the open space 78 and into the engine environment.

Through this operation of the damper 52, the volume of the high pressure chamber 38 is effectively variable, depending on the position of the piston 60. In an exemplary embodiment, the position of the piston 60 is dependent on the pressure in the high pressure chamber 38. For example, when the pressure is below a threshold value, the spring 62 exerts a sufficient force to maintain the damper 52 in the closed position. However, when the pressure in the high pressure chamber 38 exceeds the threshold, the force exerted on the first portion 66 of the piston 60 becomes greater than the spring force, and the piston is moved to the open position.

The spring 62 is depicted as a coil spring, but other springs are possible. In other embodiments, the spring 62 may be an alternative or additional force-producing component, such as a magnet, valve, clamp, or the like. The spring 62 is selected to define the threshold value as an appropriate pressure level. For example, the size and strength of the spring 62 is selected to effect a desired force on the piston 60. In an exemplary embodiment, the spring 62 exerts a force on the piston 60 in a direction opposite of the force exerted by the hydraulic fluid on the piston 60.

According to the disclosed embodiment, the damper 52 is capable of reducing a change in pressure that would otherwise occur in the high pressure chamber 38 due to operation of the variable valve train module 26. For example, when the pressure in the high pressure chamber 38 exceeds the threshold value, the piston 60 is moved against the force of the spring 62 and the open space 78 is exposed to allow hydraulic fluid to flow therein (e.g., the hydraulic fluid which pushed the piston 60 to the open position). This allows the pressure in the high pressure chamber 38 to level off (at least temporarily), thereby avoiding an otherwise greater pressure change. When the pressure in the high pressure chamber 38 reduces below the threshold, the spring force becomes greater than the pressure force on the piston 60 and the piston 60 is moved back to the closed position. This forces at least some of the fluid out of open space 78 and back through the inlet channel 56 and orifice 54 and into the high pressure chamber 38. In some instances, at least some of the fluid leaves via the leak gap 80.

Figure 4A:
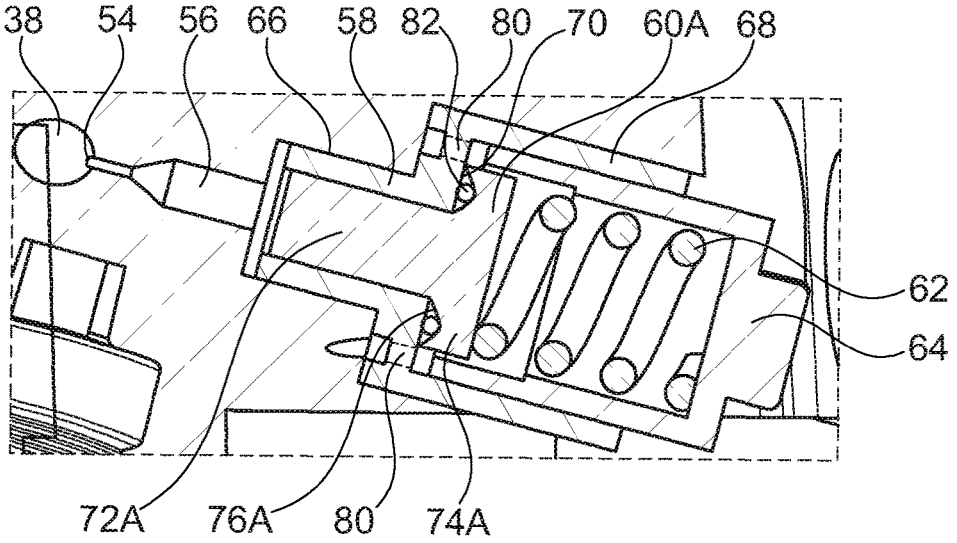
FIG. 4A is a cross-sectional view of a fluid damper which may be used in conjunction with the variable valve train module of FIG. 2, in a first position.
Figure 4B:
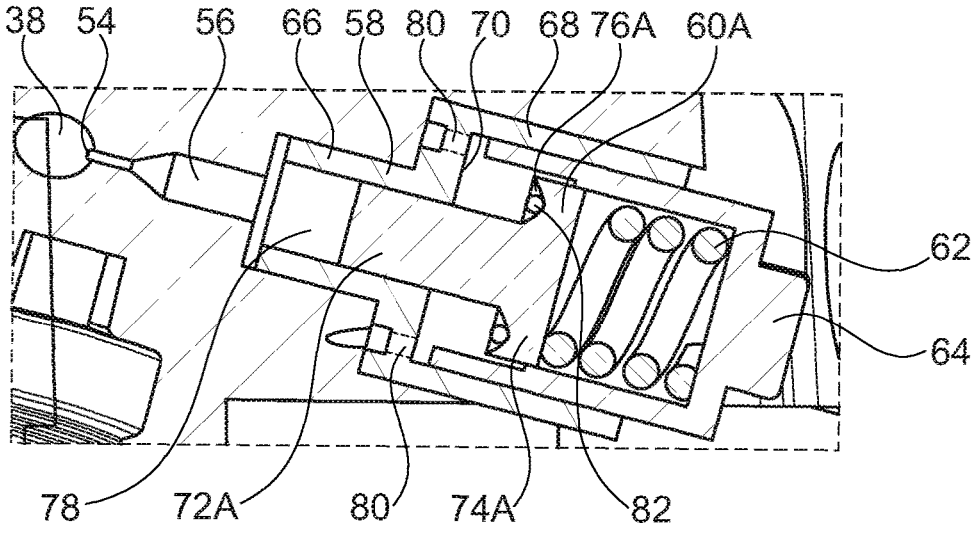
FIG. 4B is a cross-sectional view of the fluid damper of FIG. 3A, in a second position.

FIGS. 4A and 4B illustrate a damper 52A according to an alternative embodiment. The damper 52 may include the same or similar guide 58, spring 62, and retaining cap 64 and may operate in substantially the same way as the damper 52. These components may be used in conjunction with a piston 60A, which is similar to the piston 60 in that it includes a first portion 72A and a second portion 74A. The second portion 74A includes a resilient element 82 connected to a contact surface 76A. The resilient element 82 may be an o-ring, gasket, or the like. The resilient element 82 creates a buffer between the contact surface 76A and the support surface 70. In this way, when the damper 52A is moved from the open position of FIG. 4B to the closed position of FIG. 4A, the resilient element 82 will inhibit noise from being produced through contact of the piston 60A and the guide 58.

The disclosed damper for a variable valve train module provides a device which operates to reduce pressure spikes within a high pressure chamber. These pressure spikes may include pressure values which are greater than what is needed to operate the associated valve and may otherwise cause unwanted engine noise and vibration. The damper receives some of the hydraulic fluid only when the pressure value reaches a threshold level, thereby limiting the use of the damper to selected pressure values and not interfering with other situations. Moreover, the simple and compact design of the disclosed damper allows it to be installed in the same block as the other module components without taking up a large amount of packaging space. The optional feature of a resilient element also helps to reduce the potential for noise within the engine.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A variable valve train module, comprising:

a driver configured to transfer motion from a cam which rotates on a camshaft;

a pump which is configured to be driven by the driver;

a hydraulic control unit that controls an engine valve, comprising:

a high pressure chamber containing hydraulic fluid which is selectively pressurized by the pump, a control valve which is configured to depressurize the high pressure chamber, and a damper which increases an effective volume of the high pressure chamber when a pressure in the high pressure chamber exceeds a threshold value, and wherein the damper includes a guide, a piston slidably received in the guide, and a spring which biases the piston toward a closed position relative to the guide.

2. The variable valve train module of claim 1, wherein the damper is fluidly connected to the high pressure chamber by an orifice which supplies the hydraulic fluid to the damper.

3. The variable valve train module of claim 2, wherein the hydraulic fluid is configured to exert a force on the piston to move the piston to an open position relative to the guide when the force exceeds a force of the spring.

4. The variable valve train module of claim 3, wherein an open space is formed when the piston is moved to the open position, and wherein the open space receives the hydraulic fluid.

5. The variable valve train module of claim 2, wherein the orifice is fluidly connected to the damper by an inlet channel.

6. The variable valve train module of claim 5, wherein the orifice includes a diameter within 25% of 1 mm and the inlet channel includes a length within 25% of 2-3 mm.

7. The variable valve train module of claim 1, wherein the guide includes a first hollow portion and a second hollow portion which is wider than the first hollow portion such that a support surface is formed at a juncture between the first hollow portion and the second hollow portion.

8. The variable valve train module of claim 7, wherein the piston includes a first portion and a second portion which is wider than the first portion such that a contact surface is formed, and the contact surface abuts the support surface when the damper is in the closed position.

9. The variable valve train module of claim 8, wherein the damper is fluidly connected to the high pressure chamber such that the hydraulic fluid is configured to exert a force on the first portion of the piston, the force moves the piston to an open position relative to the guide when the pressure in the high pressure chamber is greater than the threshold value, and the contact surface is moved away from the support surface when the piston is moved to the open position.

10. The variable valve train module of claim 9, wherein the force of the hydraulic fluid on the piston acts in an opposite direction of the biasing of the spring.

11. The variable valve train module of claim 8, wherein the piston includes a resilient element which acts as a buffer between the contact surface and the support surface when the piston is in the closed position relative to the guide.

12. The variable valve train module of claim 11, wherein the resilient element is an o-ring.

13. The variable valve train module of claim 1, further including a retaining cap which positions the spring relative to the guide and the piston.

14. The variable valve train module of claim 1, wherein the control valve selectively connects the high pressure chamber to an intermediate chamber.

15. The variable valve train module of claim 14, wherein the intermediate chamber includes a hydraulic accumulator.

16. A variable valve train module, comprising:

a drive element configured to be driven by a cam which rotates on a camshaft;

a pump which is driven by the drive element;

a hydraulic control unit configured to control an engine valve, comprising:

a high pressure chamber containing hydraulic fluid which is selectively pressurized by the pump, a control valve which is configured to depressurize the high pressure chamber, and a damper which is configured to increase an effective volume of the high pressure chamber when a pressure in the high pressure chamber exceeds a threshold value, wherein the damper includes a guide, a piston slidably received in the guide, and a spring which biases the piston toward a closed position relative to the guide, wherein the guide includes a first hollow portion and a second hollow portion which is wider than the first hollow portion such that a support surface is formed at a juncture between the first hollow portion and the second hollow portion, and wherein the piston includes a first portion and a second portion which is wider than the first portion such that a contact surface is formed, and the contact surface abuts the support surface when the damper is in the closed position.

* * * * *